United States Patent [19]

Page, Jr.

[11] 4,140,315

[45] Feb. 20, 1979

[54] FOOTBALL BLOCKING TRAINING APPARATUS

[76] Inventor: John S. Page, Jr., 10424 Echo River Ct., Fountain Valley, Calif. 92708

[21] Appl. No.: 783,979

[22] Filed: Apr. 4, 1977

[51] Int. Cl.[2] ..... A63B 67/00

[52] U.S. Cl. ..... 273/55 R

[58] Field of Search ..... 273/55 R, 55 A; 272/116; 280/11.37, 11.19

[56] References Cited

U.S. PATENT DOCUMENTS

| | | | |
|---|---|---|---|
| 2,237,600 | 4/1941 | Gilman | 273/55 R |
| 2,521,649 | 9/1950 | Pampa | 273/55 R |
| 2,934,343 | 4/1960 | Schumacher | 273/55 R |
| 3,216,724 | 11/1965 | Williams | 273/55 R |
| 3,514,105 | 5/1970 | Pillard | 273/55 R |
| 3,649,016 | 3/1972 | Kelley, Jr. | 273/55 R |
| 3,684,283 | 8/1972 | Forrest | 273/55 R |
| 3,866,914 | 2/1975 | Jackson | 273/55 R |

*Primary Examiner*—William H. Grieb
*Assistant Examiner*—T. Brown
*Attorney, Agent, or Firm*—William W. Haefliger

[57] ABSTRACT

Athletic training apparatus includes a frame to be lifted by an athlete's shoulder, and shifted from side to side, there being weight on the frame. The frame includes an elongated horizontal member having spaced apart pads attached at one of its ends and having a skid, roller or being pivotally anchored at its other end. The frame further includes a weight member which can be slidably adjusted lengthwise between the ends of the elongated frame member. The weight member includes an upstanding post attached to a slider for receiving weights.

5 Claims, 6 Drawing Figures

FIG. 1.
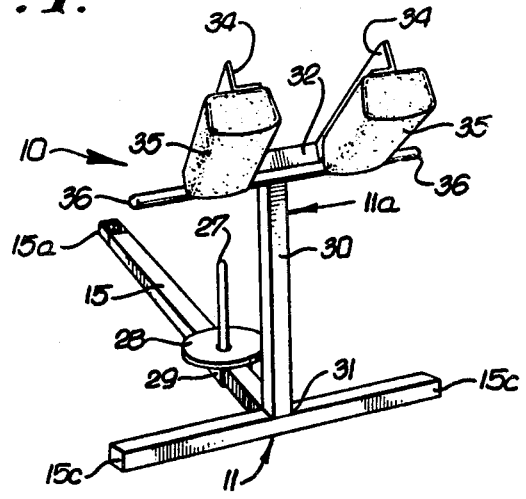
FIG. 2.
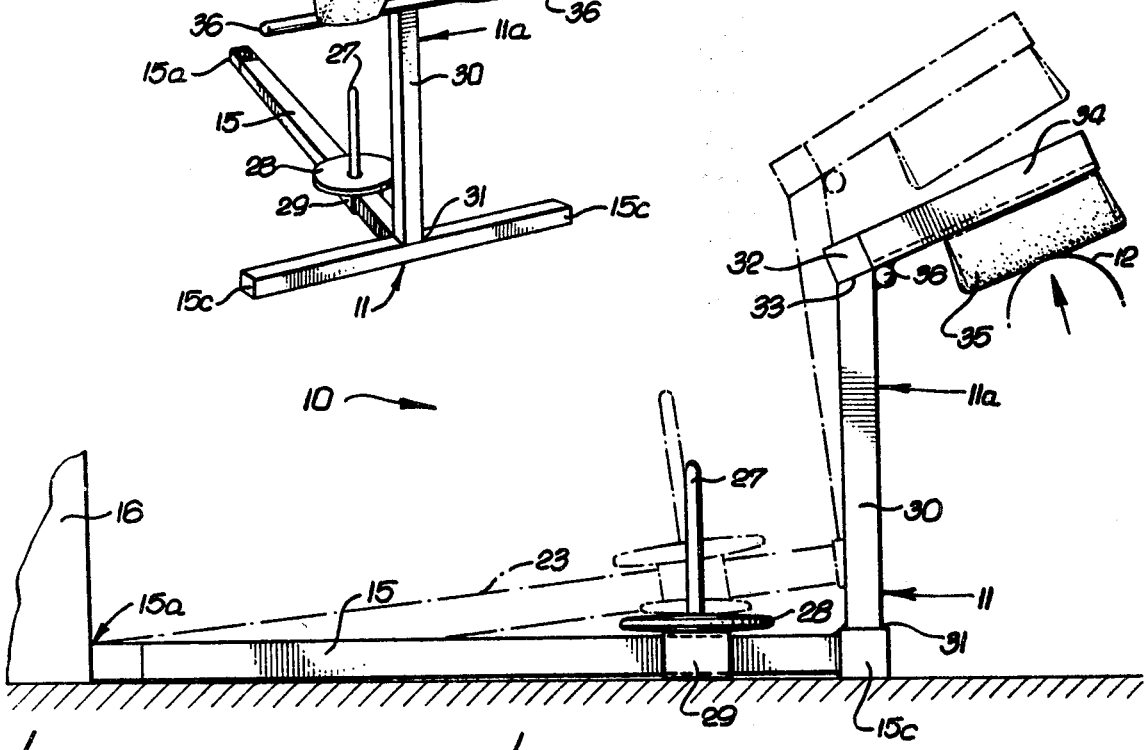
FIG. 3c.
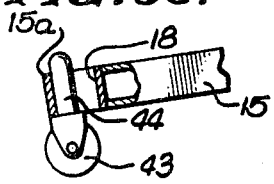
FIG. 3.
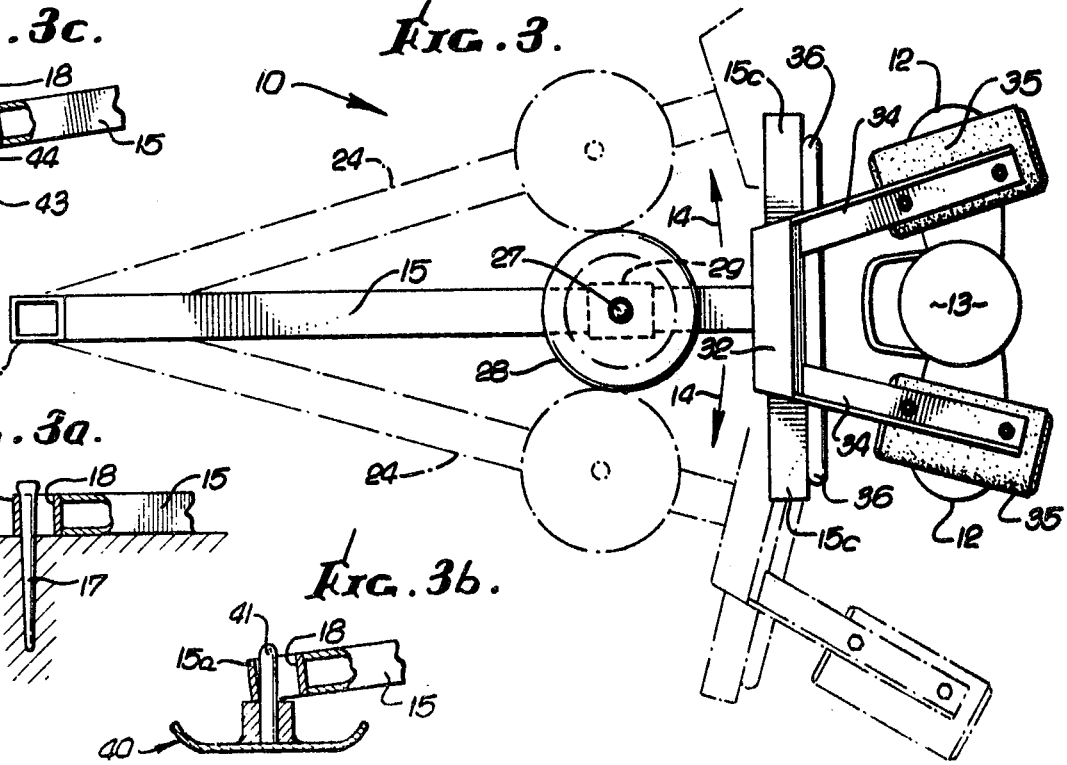
FIG. 3a.
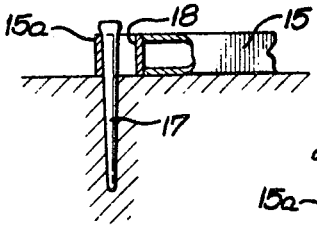
FIG. 3b.

FOOTBALL BLOCKING TRAINING APPARATUS

BACKGROUND OF THE INVENTION

This invention relates generally to athletic training apparatus, more particularly concerns apparatus for developing a football player's blocking capability.

There is a constant need for simple, effective, low-cost training apparatus, particularly for use by football players who must develop blocking capability. Previously, players have pushed against sleds, weighted sacks or bags; however, this does not sufficiently develop all the leg muscles required as the blocker pushes against another player and "dances" to left to right as the other player tries to move around the blocker. Other devices used as training aids for this purpose lack the unusual combinations of structure, function and results as are now enabled by the present invention.

SUMMARY OF THE INVENTION

It is a major object of the invention to provide training apparatus to overcome problems with prior apparatus and to meet the particular needs of football blockers who required special leg muscle development. Basically, the apparatus comprises:

(a) a frame having rearward structure to be lifted by a football player's shoulders, (b) the frame having a forward end about which said rearward structure may be pivoted laterally as the player quickly moves from side-to-side while facing forwardly.

Further, and as will appear, provision is made for adjustable weighting of the frame to be moved from side-to-side by the blocker; and the rear structure may include simple means enabling the blocker to shoulder lift the structure and to hang onto handles, as he moves rapidly from side-to-side.

These and other objects and advantages of the invention, as well as the details of an illustrative embodiment, will be more fully understood from the following description and drawings, in which:

DRAWING DESCRIPTION

FIG. 1 is a perspective view of training apparatus embodying the invention;

FIG. 2 is an enlarged side elevation view of the FIG. 1 apparatus;

FIG. 3 is an enlarged plan view of the FIG. 1 apparatus; and

FIGS. 3*a*, 3*b* and 3*c* are fragmentary sections of end portions of forward frame members.

DETAILED DESCRIPTION

In the drawings, the appartus 10 for developing a football player's blocking capability includes a frame 11 having rearward structure **11*a* to be lifted by a player's shoulders, indicated at 12. The players helmet appears at 13 in FIG. 3**.

The frame has a forward support about which rearward structure (as at **11*a*) may be pivoted laterally (as indicated by arrows 14 in FIG. 3) as the player quickly moves from side-to-side, while facing forwardly. For example, the frame may include a forwardly elongated member 15 defining a forward end at 15*a* which digs into the turf, or may be placed against an upright 16; alternatively, a simple pivot pin 17 may be removably inserted downwardly through an opening 18 in the forward end, the pin penetrating the turf. Accordingly, the frame may be tilted up by the player, as for example to the broken line tilt position indicated at 23 in FIG. 2, so that the frame may then be moved side-to-side as indicated by broken lines 24 in FIG. 3**, to exercise and strengthen the player's legs.

FIGS. 1–3 also show the provision of an adjustable weight carried by the frame to impose resistance to upward tilting of the frame, as described. In the example, an upright post 27 is carried by the member 15, and one or more annular weights 28 may be received on the post, as shown, as via openings in the weights. If desired, a slider 29 may be loosely fitted on the member 15 to slide lengthwise thereon to selected position, and the post 27 may be carried by the slider, whereby further weight adjustment is achieved.

The illustrated rearward structure **11*a* may include an upright 30 connected at its lower end to the rear extent of member 15, as at 31. Note transverse lower members 15*c* integral with member 15, to engage the ground for stabilization. A transverse member 32 is rigidly connected at 33 to the top of the upright; rearwardly extending arms 34 are connected to the member 32 at laterally spaced locations; and shoulder pads 35 are connected to the arms. Handles 36 are connected to member 32** to extend transversely as shown, to be grasped by the user as he elevates the rearward frame structure and moves his legs left and right.

FIG. **3*b* shows a skid 40 carried at the forward end 15*a*, as via a pin 41 loosely carried in hole 18; and FIG. 3*c* shows a roller 43 carried at forward end 15*a*, as via attachment 44**. These enable usage on a field or in a gym, allowing the athlete to move forwardly as well as side-to-side.

I claim:

1. In apparatus for developing an athlete's coordination and strength capability, the combination comprising (a) a frame having rearward structure to be lifted by the athlete, (b) the frame having a forward end relative to which said rearward structure when elevated may be displaced laterally as the athlete quickly moves from side-to-side while facing forwardly, (c) adjustable weight to impose resistance to said upward lifting of said rearward structure, said frame including a forwardly elongated member, said weight carried by said member, there being an upright post, said weight removably received on the post, (d) a slider on said member to move lengthwise thereof, the post being operatively connected to the slider to be adjustably moved together with the weight along said member, and (e) said rearward structure including an upright connected to rearward extent of said member, a transverse member on the upright, and shoulder padding carried by said transverse member.

2. The combination of claim 1 including handles carried by said upright, forwardly of said padding.

3. The combination of claim 1 wherein said forward end defines an opening to receive a downwardly extending pin.

4. The combination of claim 1 including a skid carried by said frame proximate said forward end.

5. The combination of claim 1 including a support roller carried by said frame proximate said forward end.

* * * * *